United States Patent [19]

House

[11] Patent Number: 4,572,745

[45] Date of Patent: Feb. 25, 1986

[54] SINGLE-AIR TRAVELING SUCTION BLOWER CLEANER WITH AUTOMATIC DOFFING

[75] Inventor: Thomas R. House, Charlotte, N.C.

[73] Assignee: Parks-Cramer Company, Fitchburg, Mass.

[21] Appl. No.: 651,872

[22] Filed: Sep. 18, 1984

[51] Int. Cl.[4] ..... B08B 7/04

[52] U.S. Cl. ..... 134/10; 15/312 A; 55/290; 55/293

[58] Field of Search ..... 15/312 R, 312 A, 346; 55/290, 293; 134/10, 21, 37

[56] References Cited

U.S. PATENT DOCUMENTS

| | | | |
|---|---|---|---|
| 2,976,558 | 3/1961 | Fain | 15/312 R |
| 3,003,178 | 10/1961 | McEachern | 15/312 A |
| 3,045,274 | 7/1962 | Sohler | 15/312 A |
| 3,055,038 | 9/1962 | Black | 15/312 A |
| 3,304,571 | 2/1967 | Black | 15/312 A |
| 3,327,457 | 6/1967 | Linsl | 55/290 |

*Primary Examiner*—Chris K. Moore

*Attorney, Agent, or Firm*—Bell, Seltzer, Park & Gibson

[57] ABSTRACT

A traveling suction floor cleaner for cleaning textile mills and adapted for periodic removal of textile waste material collected by the cleaner, and comprising a suction blower fan; means for causing said suction blower fan to travel adjacent one or more textile machines; a housing for enclosing said suction blower fan; suction duct means communicating with the housing and arranged for carrying suction air and entrained textile waste material from the floor of a textile mill to the suction blower fan; the suction blower fan, the housing and the suction duct means defining a suction air path; filter means having filtration surfaces positioned within the suction air path for receiving entrained textile waste material while permitting air flow therethrough; and means for moving the filter means for successive presentation for filtration of clean filtration surfaces on the filter means to collect textile waste from the suction air path and means for concurrent successive presentation for waste removal of filtration surfaces on the filter means having collected textile waste material thereon.

36 Claims, 12 Drawing Figures

Fig-10
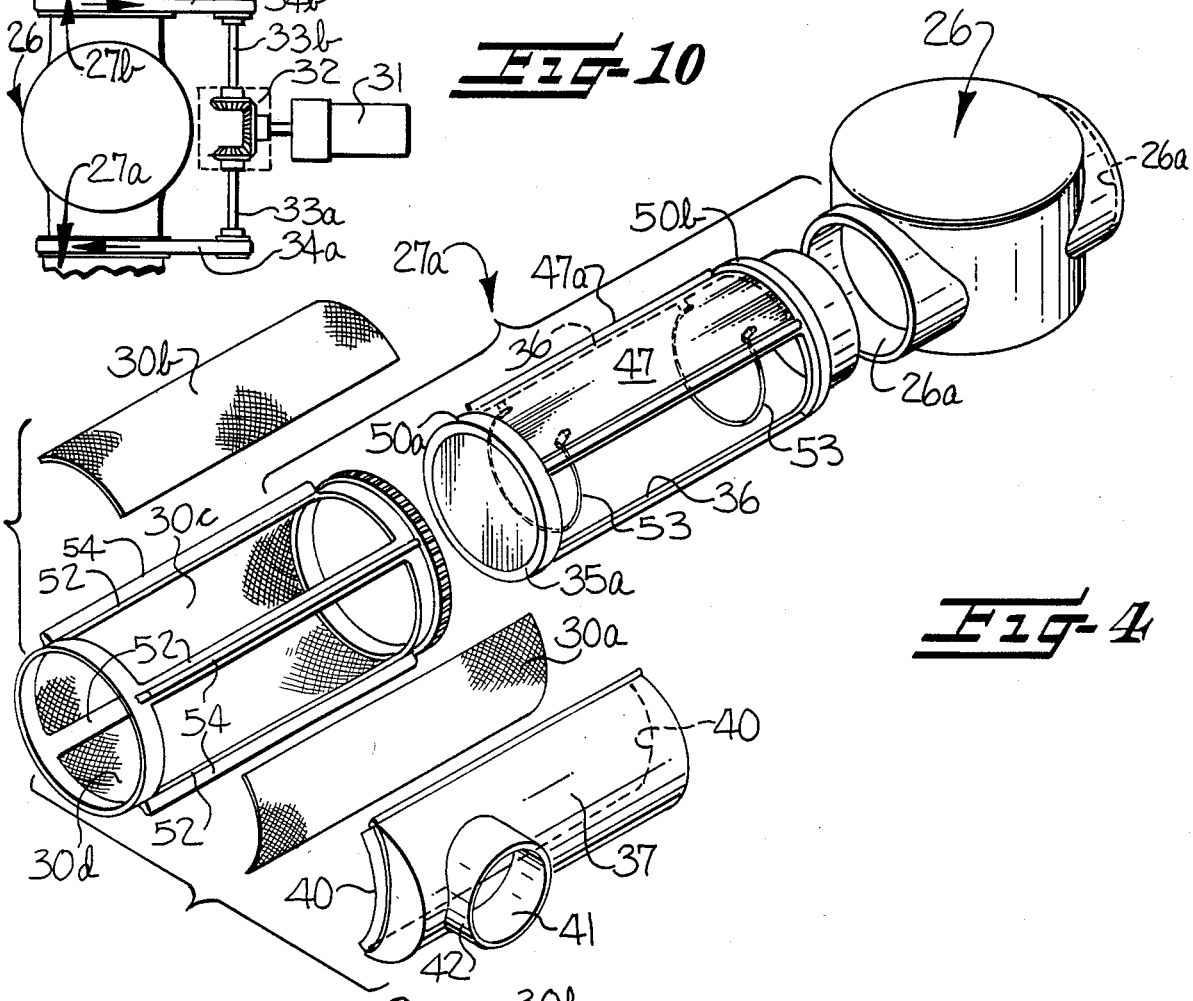
Fig-4
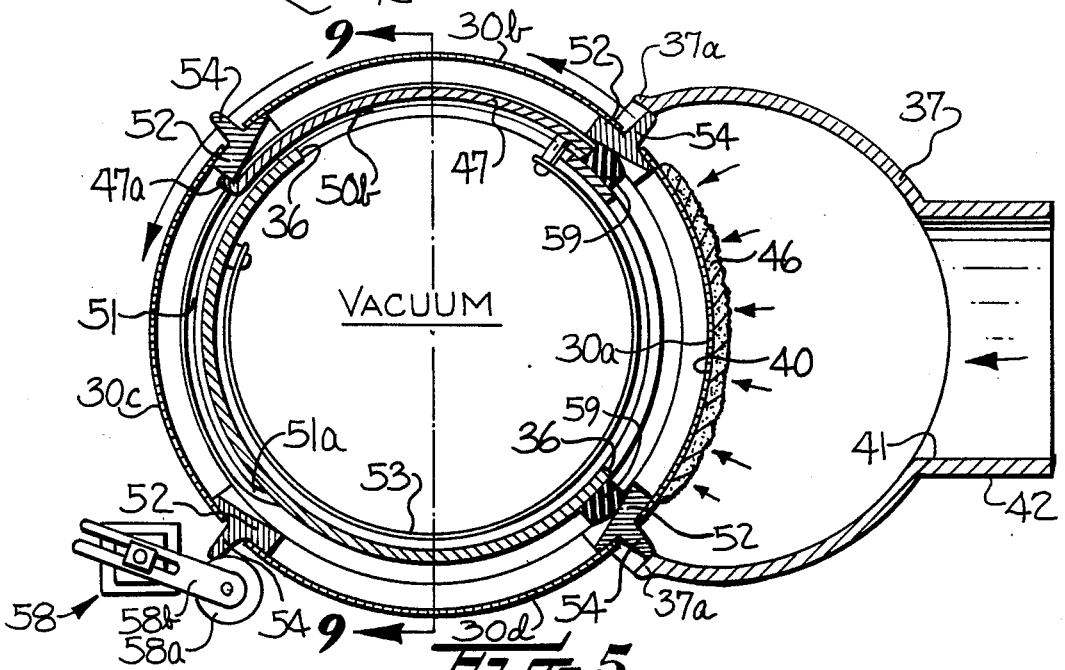
Fig-5

SINGLE-AIR TRAVELING SUCTION BLOWER CLEANER WITH AUTOMATIC DOFFING

The present invention relates to traveling suction blower cleaners of the type used in textile mills for cleaning textile waste material from textile machinery.

Traveling cleaners for textile machines which exhibit practical cleaning capabilities operate by directing one or more streams of high-velocity blowing air flow towards appropriate portions of textile machinery as the cleaner travels past that machinery. The high velocity blowing air flow dislodges textile waste material such as lint, fly and the like from the machinery, after which the waste tends to settle on the floor of the textile mill. In order to remove the textile waste material from the floor, a practical traveling suction cleaner also creates a suction air flow at approximately floor level which carries the textile waste from the floor through suction ducts carried by the cleaner, and from there into the cleaner where the textile waste material is first filtered and then collected. The blowing cleaning and suction cleaning may be accomplished by separate blowing and suction cleaners or by a cleaner combining both functions.

As is known to those familiar with combined suction blower traveling cleaners, there are two broad features or methods of operation by which they may be characterized, with each feature having alternative possible arrangements such that there exists several possible broad structural embodiments of traveling cleaners. As will be defined further herein, such traveling cleaners are either single-air or double-air with respect to the air flow paths which they define, and either feature suction-side filtration or exhaust-side filtration of textile waste material which has been picked up by the suction ducts and entrained in the air flow created by the traveling cleaner.

"Single-air" refers to a type of traveling cleaner construction in which a single impeller creates low pressure zones on the inlet side for suction air flow and high pressure zones on the outlet side for blowing air flow. Such cleaners have an advantageous mechanical simplicity resulting from the use of the single impeller and the single-air path from the suction side through the blowing side of the cleaner. Similarly, the energy requirements of motors used to drive a single impeller in single-air cleaners can be more moderate. Because, however, a single-air path is used for both blowing air flow and suction air flow, such cleaners are likely to have reduced efficiency characterized by low blowing side pressures and reduced velocity resulting from the decrease in air flow which generally occurs when a sufficient amount of waste material has become built up on the filter in the single-air path. Reduced air velocity can seriously impair the effectiveness of the blowing cleaning and, while not as critical, reduced air flow also reduces suction pick-up effectiveness.

The "double-air" type of cleaner solves certain of the problems presented by the single-air cleaner by using two impellers (often positioned on a common axis) and two separate air paths, isolated from one another, one for suction and one for blowing. Because suction and filtration take place in only the suction air path while blowing occurs through a separate, isolated air path, the filtration and consequent build-up of waste material in the suction air path does not hinder the air flow in the blowing air path. Double-air cleaners are characterized by their elimination of the hindered flow of single-air cleaners, but are necessarily heavier, mechanically more complex and generally call for greater amounts of energy in order to power and carry two impellers and to provide two air flows of sufficient velocity for efficient machine cleaning.

As for the other characteristics, "suction-side" filtration refers to a traveling cleaner construction in which the filter which collects the textile waste material is positioned in the suction air path on the inlet side of the cleaner fan, single or double-air, prior to the point at which the air reaches the impeller. Suction-side filters have the advantage of isolating the impeller and its mechanism from exposure to dirty air, but have the disadvantages, in both single-air and double-air systems, of quickly building up a relatively stationary batt of textile fiber waste material, resulting in reduced velocity, reduced air flow volume and consequent reduced overall efficiency in suction and blowing cleaning.

Exhaust-side filtration traveling cleaners, whether single-air or double-air, have the filtration apparatus positioned in the air path such that air to be filtered passes through the impeller before it is filtered. Such positioning of the filter facilitates collection and removal of collected waste and generally results in less interference with the air flow. Nevertheless, positioning the air filter on the exhaust side of the impeller requires that the impeller and any exposed driving mechanism for the impeller be constructed for material handling, i.e. to handle dirty air. Such construction adds various associated complications to the mechanical construction of the traveling cleaner.

For reference purposes, the following patents are illustrative of the art:

Holtzclaw; No. 3,011,202
Sohler; No. 3,045,274
Kulp; No. 3,053,700
Black; No. 3,055,038
McEachern; No. 3,080,598
King; No. 3,245,103
Black; No. 3,304,571
Black; No. 3,429,745
Black; No. 3,437,520

It is an object of the present invention to avoid the characteristic disadvantages of all of the aforementioned types of construction, while retaining most of their concurrent advantages. More specifically, it is an object of this invention to provide a single air suction floor cleaner with automatically purged filter means whereby cleaning efficiency is comparable to that of double air cleaners with savings in operating and energy costs comparable to single air cleaners.

Another characteristic of traveling suction floor cleaners is the necessity for periodic removal from the cleaner of the collected textile waste. In the simplest cases, a cleaner may be simply emptied by hand. Alternatively, several types of automatic waste removal or transfer mechanisms have been either built into or constructed to work in conjunction with traveling cleaners. Such automatic removal mechanisms do save manual labor, but are usually mechanically complicated and generally require the traveling cleaner to be stopped while removal takes place.

It is thus a further object of the present invention to provide a traveling suction blower cleaner from which collected textile waste may be automatically removed by a device as simple as a single vacuum hose, if desired, and additionally wherein removal may be accomplished during travel of the cleaner without being required to stop at a mechanical transfer station.

The present invention thus provides a traveling blower suction floor cleaner for cleaning textile machinery and subjacent floors and adapted for periodic purging or cleaning of the filter and removal of textile waste material collected by the cleaner, which cleaner comprises a suction blower fan; means for causing the suction blower fan to travel adjacent one or more textile machines; a housing for enclosing the fan; suction duct means communicating with the housing and arranged for carrying suction air and entrained textile waste material from the floor of a textile mill to the suction blower fan; blowing duct means for directing blowing air toward textile machines to remove lint and the like; the fan, the housing and the suction duct and blower duct means defining an air path; filter means having filtration surfaces positioned within the air path and means for moving the filter means for successive presentation for filtration of clean filtration surfaces and means for concurrent successive presentation for removal or transfer to non-traveling collection areas of filtration surfaces on the filter means having collected textile waste material thereon.

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein:

FIG. 4 is an exploded view of the filter portion of the traveling suction cleaner, the elongate tubular body upon which the filter means rests, the suction presentation chamber, and the housing;

FIG. 5 is a cross-sectional view taken along lines 5—5 of FIG. 2;

FIG. 10 is a top plan view of the motor and transmission for rotating the filter means of the present invention;

Figure 1:
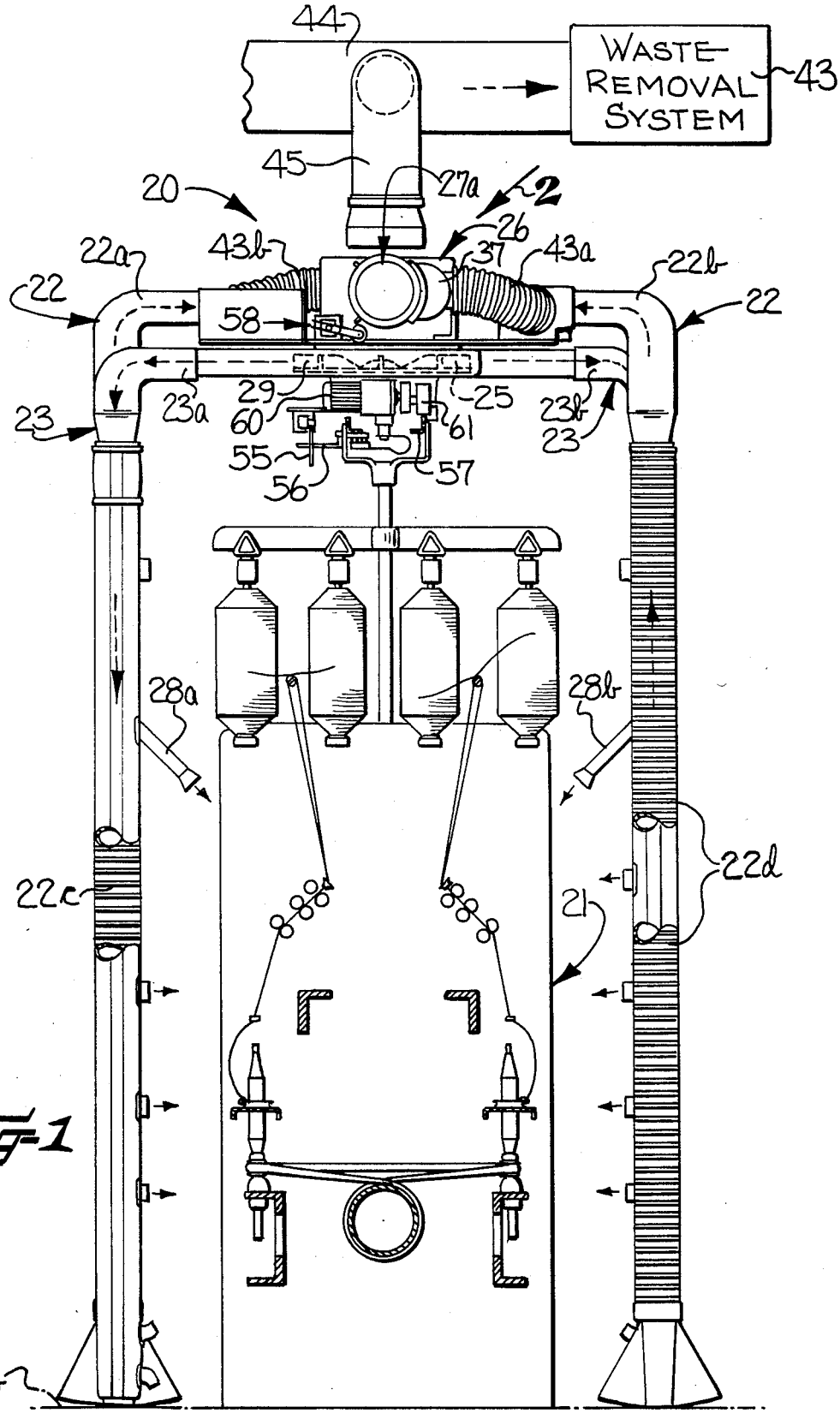
FIG. 1 is an end elevational view of the traveling cleaner of the present invention positioned over textile machinery such as a spinning frame and under a stationary suction waste removal system.

Turning to the invention in more detail, it will be seen from FIG. 1 that the invention comprises a traveling suction cleaner broadly designated at 20 adapted to be carried adjacent textile machinery broadly designated at 21 and illustrated in the form of a ring spinning frame. The environmental view of FIG. 1 particularly illustrates the preferred positioning and operation of the traveling suction cleaner with respect to textile machinery. As discussed more fully later herein, portions of the traveling suction cleaner comprise suction duct means 22, positioned on either side of the traveling suction cleaner 20. In the illustrated embodiment of the invention, the respective suction duct means comprise both rigid portions 22*a* and 22*b* and downwardly extending flexible hoses, 22*c* and 22*d* respectively, which hoses reach to the floor 24 of the textile mill.

Additionally, blower duct means 23*a* and 23*b* respectively are also positioned on the traveling suction cleaner 20. Portions of the blower duct means, shown in the drawings as branching ducts 28*a* and 28*b*, are arranged to direct the flow of blowing air against particular portions of the textile machinery to be cleaned. As is known to those familiar with the art, the arrangement of the blower outlets will depend on the particular type of machinery to be cleaned, and the present invention can accommodate such various blower duct arrangements.

As set out previously herein, the most efficient practical use of a traveling suction cleaner requires that a steady stream of blowing air, such as would be carried in the blower duct means 23*a* and 23*b* and as illustrated by the arrows drawn therein, is required to remove textile waste material, primarily fibers such as lint, fly and the like, from textile machinery. The blowing air is directed across the textile machinery and toward desired areas with sufficient velocity to blow textile waste off of the machinery during its operation, after which the waste normally settles to the floor of a textile mill. Once the waste material has settled on the floor of the mill, it is removed therefrom by the suction provided by the traveling suction cleaner. The cleaner communicates with the floor by means of the suction duct means 22*a* and 22*b* which extend outwardly and then downwardly from the traveling suction cleaner 20 to the floor 24 of a textile mill. Thus, the blowing of textile waste material off of textile machinery onto the floor of a textile mill, combined with the suction removal of such textile waste material from the floor of the mill by the traveling suction cleaner during the repeated travels of the cleaner throughout an entire mill or an entire portion of a mill, serves to keep textile machinery clean. As illustrated, there is at least one suction duct 22 on each side of the cleaner and, at least one blowing duct 23 on each side for directing blowing air toward the textile machines to be cleaned.

Figure 2:
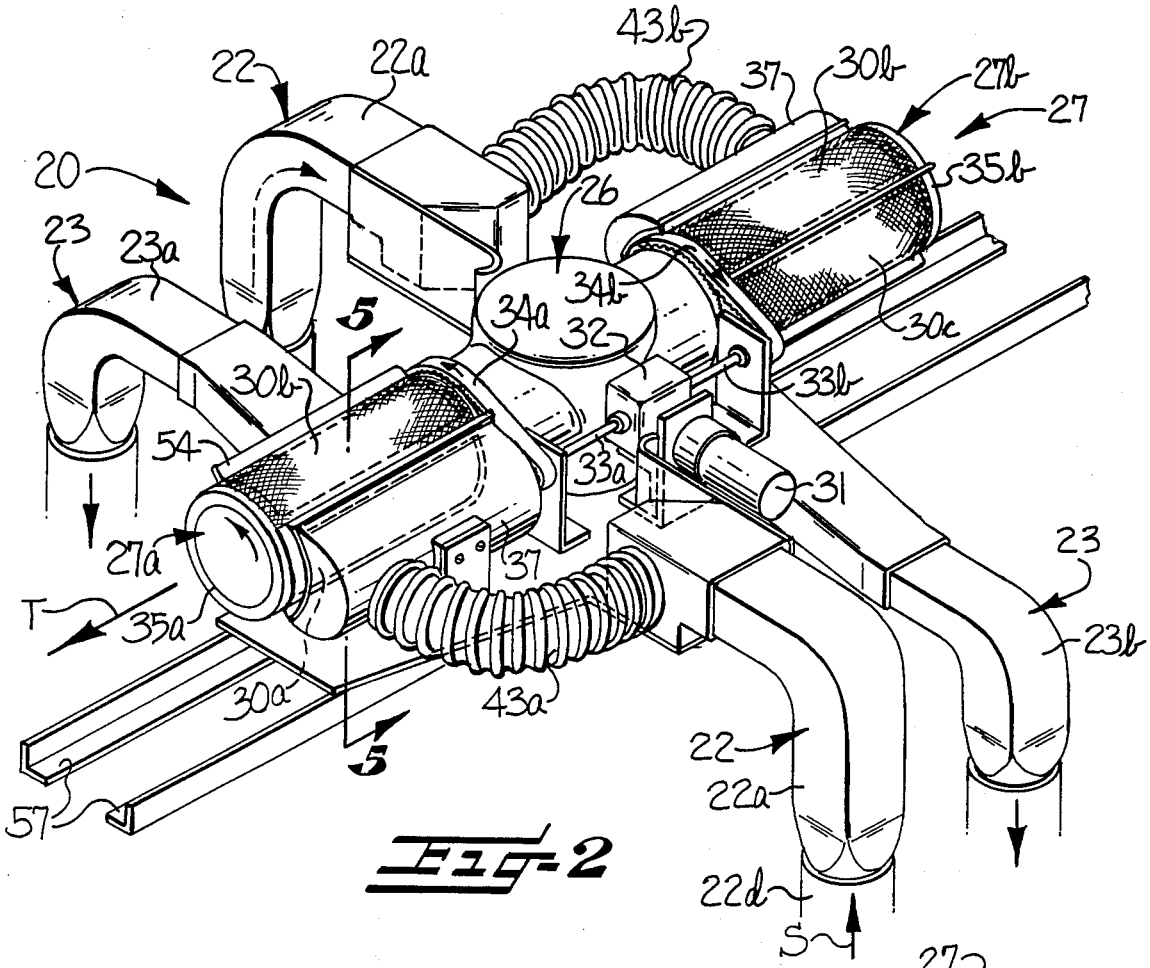
FIG. 2 is a perspective view taken generally along line 2 of FIG. 1 from above the traveling suction cleaner positioned on the tracks upon which it travels.

The traveling suction cleaner itself is best illustrated in FIGS. 1 and 2. The traveling suction cleaner includes a suction blower fan 25 enclosed within a housing 26 shown in the drawings as a generally cylindrical housing portion aligned centrally with respect to the direction of travel of the cleaner.

Figure 11:
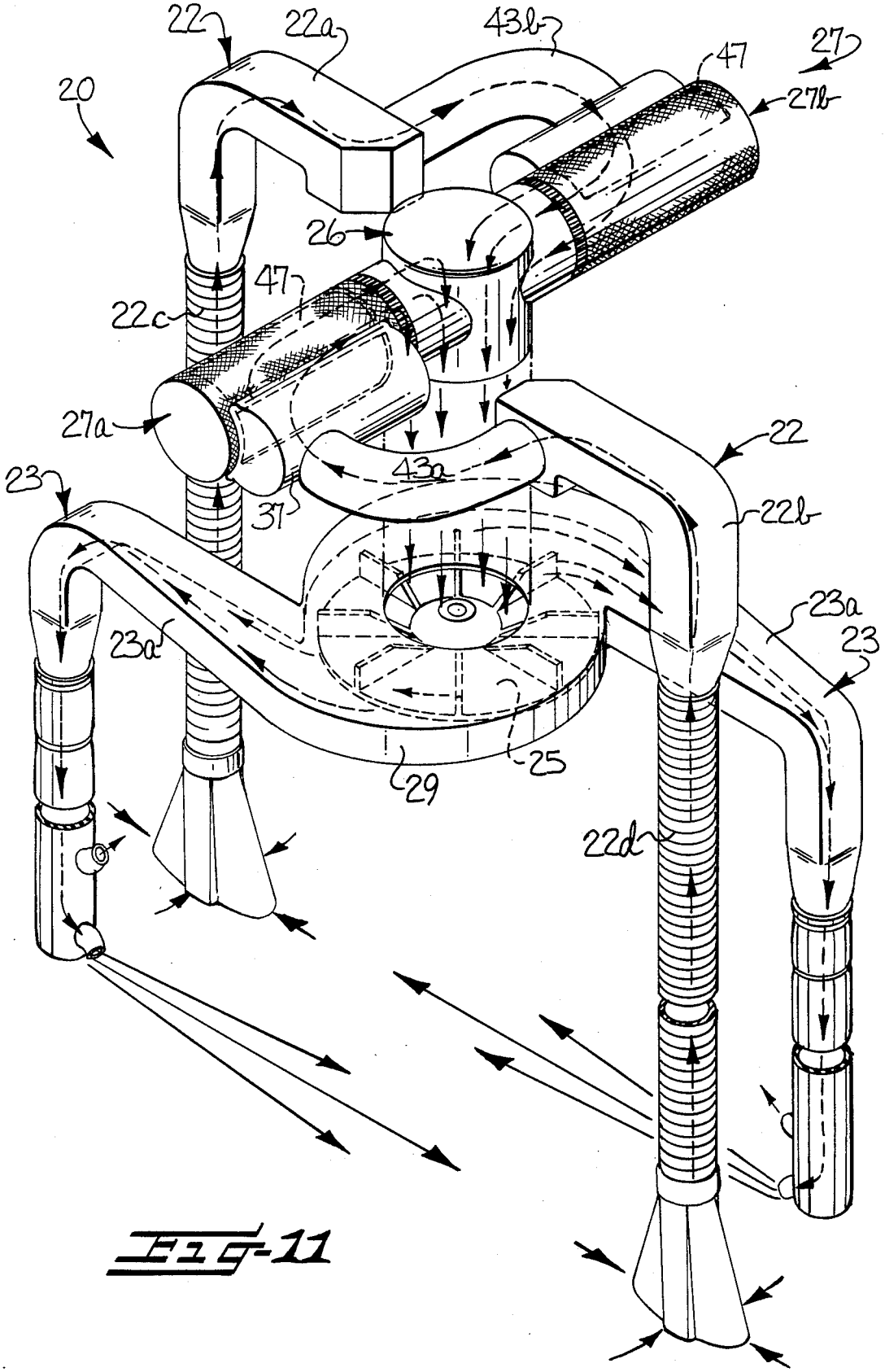
FIG. 11 is a partially exploded schematic perspective view showing the single path of the suction air and the blowing air, and the single impeller means.

As seen in FIGS. 1, 2, and 11 the suction blower fan 25, the housing 26, and the suction duct means 22*a* and 22*b* together define a suction air path S into the inlet side of the traveling suction cleaner 20 as indicated by the arrows in the respective figures. Air flows from the fan 25 and through the scroll-shaped portions 29 of the housing 26 to the blower duct means 23*a* and 23*b* to form with the suction air flow a "single-air" path.

Within the single air path there are positioned filter means broadly designated at 27. In the preferred embodiment illustrated by the drawings, the cleaner 20 includes two such filter means, broadly designated at 27*a* and 27*b*, respectively. The filter means 27*a* and 27*b* further comprise filtration surfaces 30*a*, 30*b*, 30*c* and 30*d*, portions of at least one of which are always preferably positioned within the suction air path S and communicate with the suction duct means 22*a* and 22*b* and with the suction blower fan 25. In the embodiment of the invention illustrated in the drawings, the filter means 27*a* and 27*b* comprise cylindrical tubular filters which in turn each comprise a series of arcuate conjoint foraminous sections. FIG. 2 illustrates one respective filtration surface, designated 30*a*, which is positioned within the suction air path and a preceding section of filtration surface, designated at 30*b*, which has been rotated out of registration with the suction air path.

Further to the objectives of the invention the present cleaner is characterized by means for moving the filter means 27 so that successive clean filtration surfaces 30*a* are presented to the suction air path for filtration while other filtration surfaces, generally having collected textile waste material thereon, 30*b* are concurrently presented for waste removal. This in effect purges the waste-loaded filtration surface by removing it from the air stream and permits unhindered air flow through the clean surface 30*a*. The means for moving the filters 27*a* and 27*b* comprises a motor 31, a transmission 32, drive shafts 33*a* and 33*b* and toothed belt and gear arrangements 34*a* and 34*b* respectively. The motor 31 is most conveniently mounted on the fan housing 26 of the traveling carriage and drives the transmission 32 which is positioned on middle portions of the housing 26. As best shown in FIGS. 2 and 10, drive shafts 33*a* and 33*b* extend laterally, in a direction parallel to the direction of travel on either side of the transmission 32. The drive shafts 33*a* and 33*b* drive gear and belt mechanisms generally indicated at 34*a* and 34*b* which respectively serve to rotate the filter means 27*a* and 27*b*.

In operation, the filter means 27*a* will rotate in a counterclockwise direction with respect to the view of FIG. 2, and filter means 27*b* will rotate in a clockwise direction with respect to the same view.

Figure 3:
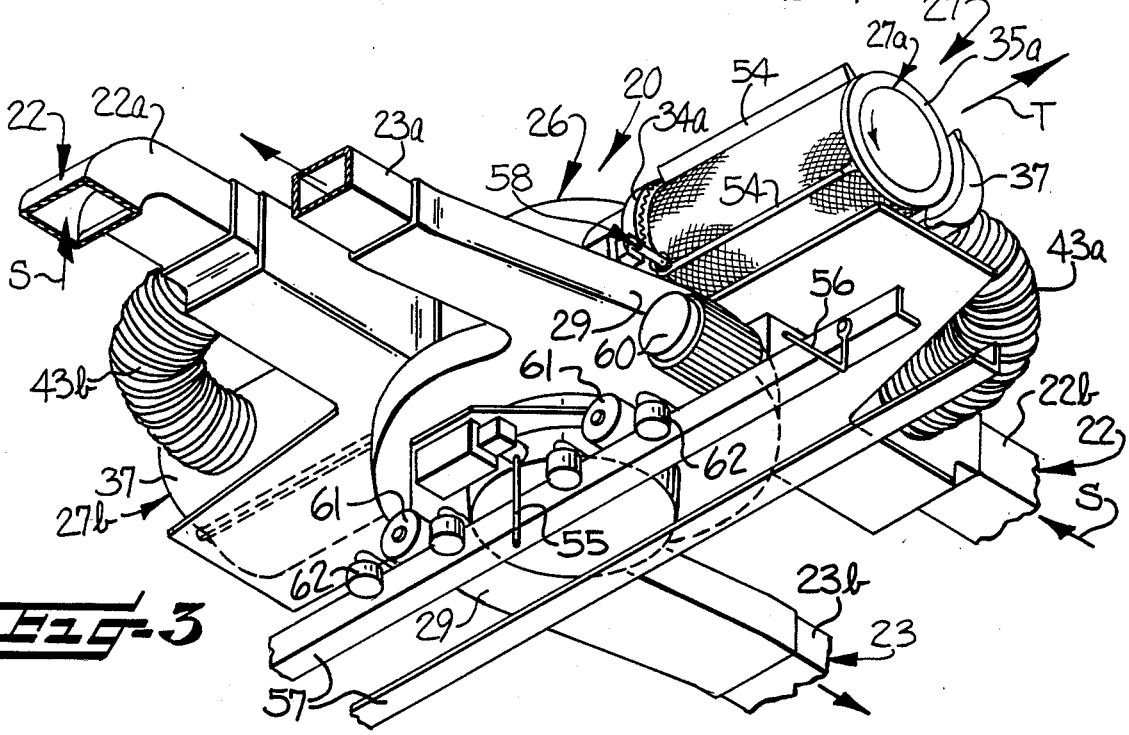
FIG. 3 is a perspective view taken from generally underneath the traveling suction cleaner and showing the cleaner positioned on the tracks upon which it travels.

In order that the filter means 27*a* and 27*b* and the suction duct means 22*a* and 22*b* may efficiently communicate with the filtration surfaces 30*a* and with the suction blower fan 25 in the housing 26, there are provided elongate tubular bodies 35*a* and 35*b*, shown in FIGS. 2, 3 and 4 as cylinders, extending longitudinally from the housing 26 in opposite directions generally parallel to the direction of travel T. The inboard, general longitudinal arrangement of the tubular bodies 35*a* and 35*b* helps balance the traveling unit and reduces its lateral overhang. As shown by FIG. 2, the filter means 27*a* and 27*b* overlie the elongate tubular bodies 35*a* and 35*b*. The tubular bodies 35*a* and 35*b* thus serve to position the filter means 27*a* and 27*b* in communication with both the fan housing 26 and the suction duct means 22*a* and 22*b*. Consequently, the tubular bodies 35*a* and 35*b* also serve to position the filter means 27*a* and 27*b*, and particularly the filtration surfaces 30*a* thereof, within the suction air path S.

In order to allow suction air to flow from the suction duct means 22*a* and 22*b* to the fan 25 in the housing 26, there is provided in the elongate tubular body 35*a* and 35*b* a longitudinally extending air ingress opening 36 which is best illustrated in the exploded partial view of FIG. 4, which shows various components of the preferred embodiment of the traveling suction cleaner and illustrates certain of its operative features. Also included in this view are the housing 26, one of the filter means 27*a*, filtration surfaces 30*a* and 30*b* of filter means 27*a*, and a chamber 37, communicating with suction duct means 22*a* and 22*b*, for presenting suction air to the filtration surface 30*a* of the filter means 27*a* while isolating the filtration surface 30*a* from environmental air. With the chamber 37 in place, the suction blower fan 25 draws air exclusively from the suction duct means 22*a* and 22*b* independent of other environmental air in a textile mill. In the illustrated embodiment of the invention, the chamber 37 comprises a partial cylinder having one opening therein 40 for communication with the filtration surface 30*a* of the filter means 27*a*, and another opening 41 shown in the form of an annular member 42 positioned perpendicularly in the presentation chamber 37. As can be seen more clearly in FIG. 2, the opening 41 communicates with flexible hose portions 43*a* and 43*b* of the suction duct means 22*a* and 22*b*. The air isolation functions of the presentation chamber 37 will be discussed in greater detail later herein.

Returning to the structure and function of the elongate tubular bodies 35*a* and 35*b*, it will be seen from FIGS. 4 and 5 that when the filter means 27*a* is positioned in surrounding relation to the elongate tubular body 35*a*, suction air entering the elongate tubular body will first pass through the opening 41 in the presentation chamber 37 and then against and through the filtration surface 30*a* of the filter means 27, upon which entrained textile waste material will be collected. The suction air will next pass through air ingress opening 36 in elongate tubular body 35*a*, then into the elongate tubular body 35*a* itself and finally into the inlet 26*a* of the fan housing 26.

As set forth earlier, the present invention thus provides a novel means of successively presenting different, clean filtration surfaces to a suction air path rather than requiring one filtration surface to be continuously bombarded with suction air carrying entrained textile waste.

Accordingly, it will be seen from FIGS. 2 and 4, where the filter means 27*a* comprises a series of conjoint foraminous arcuate sections, of which 30*a* and 30*b* represent two such sections, that as the action of the motor 31, the transmission 32 and the associated shafts and gears 33 and 34 causes the filter means 27*a* to rotate, succeeding filter sections are repetitively presented to the suction air path. In the illustrated embodiment of the invention there is shown a filter means having four such arcuate sections, but it will be understood from the specification and the claims that the present invention is not limited to either four such sections or to arcuate sections.

In order for clean filtration surfaces to be successively presented to the suction air path, however, textile waste material collected on respective filter surfaces 30*a* of the filtration means 27*a* must periodically be purged. In this regard, and as best illustrated in FIGS. 1 and 2, the present invention provides an improved method for removing waste from the filtration surfaces of a traveling suction cleaner. In contrast to various prior traveling suction cleaners which required either hand emptying, intricate suction flow paths or complicated mechanical devices, the present traveling suction cleaner simply presents respective successive clean filtration surfaces to the airstream while moving waste laden surfaces from the airstream to permit removal of the waste thereon by any convenient removal means.

As can be appreciated from FIGS. 2 and 5, when filter means 27*a* is rotated counterclockwise with respect to the view of FIG. 2, filter surface 30*a* will be rotated clockwise from its illustrated position to the position occupied by illustrated filter section 30*b*. Likewise, filter section 30*b* will be moved to a further counterclockwise position not visible in FIG. 2, but which may be readily understood when such counterclockwise rotation of filter means 27 is contemplated. At the same time a clean third respective filtration surface, not visible in the perspective view of FIG. 2, will be rotated into the position occupied by illustrated filtration surface 30*a*. It will thus be understood that each successive stepwise rotation of the filter means 27 presents a clean filtration surface to the suction air flow while concurrently presenting for waste removal a preceding filtration surface carrying collected textile waste material thereon.

Once filter surface 30*a* has been rotated to a position corresponding to illustrated filter surface 30*b*, it may be cleaned by any convenient waste removal means. One simple method shown in FIG. 1 is a suction waste removal system 43 having various duct means 44 and 45 and suction generating means not shown for carrying purged waste from the traveling suction cleaner 20 to the waste removal system 43. As shown in FIG. 1, when the traveling suction cleaner 20 passes underneath the waste removal system 43, and in particular underneath the suction waste duct means 45, collected textile waste material on the filtration surface 30*b* positioned adjacent the duct means 45 will be presented to the waste removal system 43 as the filtration surface passes thereunder and will be stripped from that surface.

In addition to allowing simplified methods of waste removal, the traveling suction blower cleaner of the present invention offers the additional advantage that waste may be transferred without stopping the cleaner as it passes underneath the duct means 45 of the waste removal system 43. In this regard, it will be especially seen in FIG. 2 that a filtration surface 30*b* which is presented for waste transfer is so presented on the exterior of the traveling suction cleaner, thus eliminating the need for any complicated mechanisms for purging collected textile waste material from the interior of the traveling suction cleaner.

Because removal of the collected textile waste material need not take place continuously, but rather may be satisfactorily accomplished at intervals, the filter means 27 does not need to rotate continuously, but rather need only rotate at intervals. The intervals between rotations of the filter means 27 are not dependent upon any limitations of the traveling suction blower cleaner itself, but rather the cleaner is flexibly responsive to external signal means and thus the intervals of rotation can be selected to depend on the amount of textile waste material expected to be or required to be collected from the particular textile area being cleaned, the availability and number of transfer stations and the like.

Consequently, in operation the filter means 27 will remain in one position for a predetermined interval without moving. As suction air is carried from the floor 24 through the suction duct means 22 into the suction presentation chamber 37 and against the filtration surface 30*a* which is presented to the suction air flow, the textile waste material which is filtered is essentially particles of fibers such as lint or fly and these fibers will gradually build up upon the filtration surface 30*a* and form a cover or batt of textile waste material. Such a batt is designated at 46 in FIG. 5.

Before too much textile waste material has been collected on the filtration surface 30*a* which is positioned in the suction air path S, the various means to be described hereinafter move the filter means 27 for the successive presentation for filtration of clean filtration surfaces while currently successively presenting for waste removal the filtration surfaces 30 carrying the waste material 46 to be removed.

As will be understood from the present detailed descriptions, because the traveling cleaner of the present invention successively presents different cleaning sections of the filter means 27 to the suction air path S, and because the cleaner likewise concurrently successively moves other sections carrying textile waste material out of the suction air path S, the present invention avoids many of the disadvantages of ordinary suction-side filtration construction while retaining the characteristic advantages thereof. Similarly, because the successive presentation of clean filtration surfaces avoids the build up of excess textile waste material in the suction air path, the segregation of the suction air path from the blowing air path is no longer necessary. Thus, the present invention offers cleaning efficiency commensurate with double-air construction while maintaining the mechanical efficiency and simplicity of single-air construction. In this regard, working embodiments of the present invention have demonstrated blowing air velocities of up to 12,000 feet per minute using a 3 horsepower motor while operating at a sound level of approximately 80 decibels. By comparison, some presently practicable traveling cleaners of dual air construction give blowing air velocities of up to 11,000 feet per minute using 5 horsepower motors at sound levels of about 88 or 89 decibels. The present invention thus exhibits superiority in a number of important characteristics.

Figure 6:
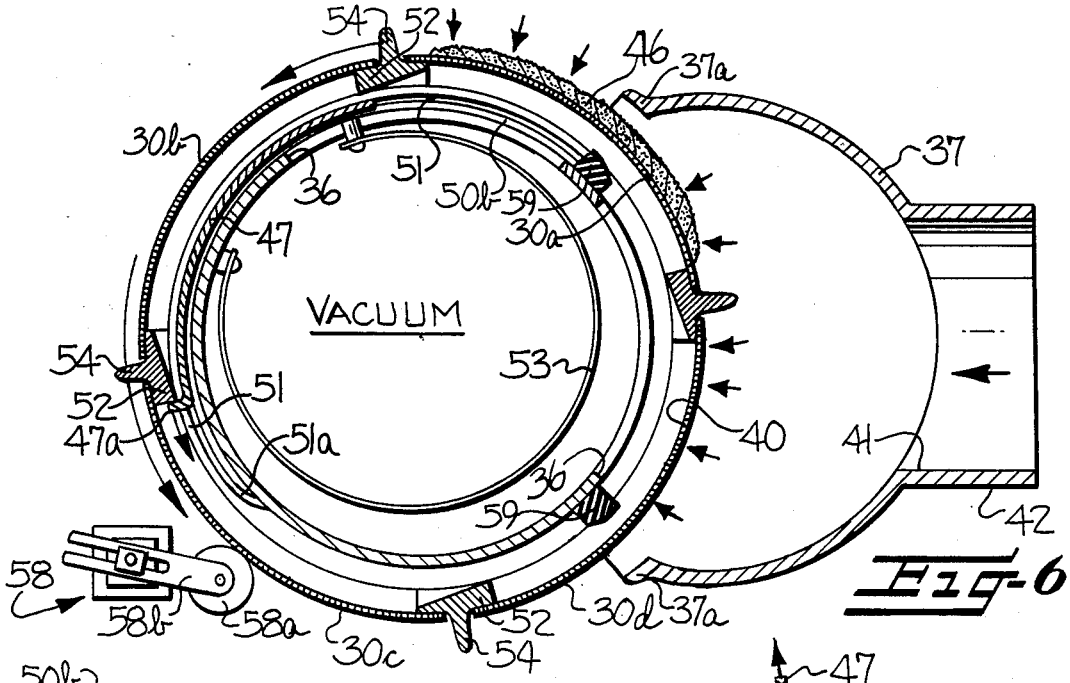
FIG. 6 is a similar cross-sectional view taken along lines 5—5, and showing partial rotation of the filter means.

FIGS. 5 and 6 illustrate the movable closure means on the present invention which partially close the longitudinally extending air ingress opening 36 in the tubular body 35*a*, and also illustrate the means associated with the movable closure means for opening the movable closure means for a predetermined interval and then returning the movable closure means to a normally partially closed position. The combined operation of these elements causes textile fiber waste to be retained on respective filter section 30*a* while the filter means 27 is being rotated for presentation of a clean filtration surface to the suction air path for filtration.

In the illustrated embodiment of the invention, and as best shown in FIG. 4, the elongate tubular body 35*a* comprises a cylinder, and the longitudinal opening 36 therein comprises an arcuate section of the cylinder. Similarly, the movable closure means for partially closing the air ingress opening 36 is shown in the form of an arcuate door 47 which rests in the normally partially closed position illustrated in FIG. 5, but which can be moved to a more open position as illustrated by FIG. 6. FIG. 6 shows the door 47 in a position partway between its normally closed position and its fully opened position. In order to be operable in timed relation with the rotation of the filter means 27, the door 47 is carried on bearing means, 50*a* and 50*b* respectively, located on opposite end portions of the elongate tubular body 35.

The bearings are annular in construction and can be composed of a material such as nylon against which moving parts may readily slide. Each annular bearing 50 carries an arcuate groove 51 in which respective side edges of the arcuate door 47 are carried. The arcuate door 47 is thus opened and closed by being slid clockwise and counterclockwise respectively in the arcuate grooves 51.

As best illustrated by FIGS. 5 and 6, the movable door 47 enables the suction air flow to cause the batt 46 of textile waste material carried on the filtration surface 30*a* to be retained thereon while filtration surface 30*a* is rotated out of registration with the suction air path. In operation, as the filter means 27 rotates, the door 47 opens and allows the suction air flow to cause the batt 46 of waste material to be carried on the filtration surface 30*a* as the filter means 27 rotates in an illustrated counterclockwise direction. It will be seen that were no means provided for retaining the batt 46 on the filtration surface 30*a* during rotation, the suction air flow through the air ingress opening 36 would tend to urge the batt to be retained only along whatever portion of the filter means 27 was in registration with the opening 36. There would thus exist no method for carrying textile waste material out of the filtration presentation chamber 37 and into position for removal.

The door 47 solves this problem. As the filter means 27 rotates, the door 47 opens and, as best shown in FIG. 6, exposes filtration surface 30*a* to a continued suction air flow even while section 30*a* is being rotated out of the suction presentation chamber 37 to the waste removal position formerly occupied by filtration surface 30*b*. Meanwhile, clean filtration surface 30*d* is being concurrently rotated into position to be presented to the air flow in the suction presentation chamber 37.

Although not specifically shown in the drawings, it will be understood that in the illustrated embodiment of the invention, when the filter means 27 has completed one 90 degree rotation from the respective position shown in FIG. 5, filtration surface 30*a* carrying the batt 46 of textile waste material will be moved to the position formerly occupied by filtration surface 30*b* and will thus be out of registration with the suction presentation chamber 37. At this point, were the door 47 to remain in the opened position partially illustrated in FIG. 6, the suction air flow would urge the batt 46 to be retained on the filtration surface 30*a*, instead of allowing it to be removed by a transfer means such as that illustrated in FIG. 1. Thus, once rotation of the filter means 27 has been completed, it is desirable that the suction air flow be cut off from the batt 46 which has been purged from the suction presentation chamber 37, so that transfer of the batt 46 may take place independent from and unhindered by the suction air flow created by the traveling suction cleaner.

The present invention provides a mechanism for accomplishing the timed opening and closing of the arcuate door 47 which timing is related to the rotation of the filter means 27. FIGS. 5 through 8 show that a portion of the arcuate door 47 comprises a lip 47*a* extending upwardly from and lengthwise along one lengthwise edge of the arcuate door 47 towards the filter means 27. There are provided on the filter means 27 means 52, shown in the form of a plurality of projecting feet, for engaging the lip 47*a*. The feet 52 are positioned on the inner periphery of the cylindrical filter means 27 and depend therefrom towards the elongate cylindrical tubular body 35 and are positioned such that upon rotation of the filter means 27, one of the respective projecting feet 52 will abuttingly engage the lip 47*a* of the arcuate door 47. As the filter means 27 rotates, the abutting of the foot 52 against the lip 47*a* carries the door 47 along a path defined by the arcuate grooves 51 in the bearings 50, and thus opens the door 47.

As pointed out earlier herein, FIG. 6 illustrates a point in the rotation of the filter means 27 corresponding to partially completed opening of the door 47. As shown in FIG. 6, the foot 52 has carried the lip 47*a* and the door 47 to a further counterclockwise open position from which it started. As stated earlier herein, the open door allows the suction air flow provided by the traveling suction blower cleaner to cause the batt 46 of waste material to be retained on the filtration surface 30*a* while rotation is taking place. The batt 46 will thus be retained on the filtration surface 30*a* through an entire 90 degree rotation of the filter means 27.

As noted previously, however, once a 90 degree rotation of the filter means 27 has taken place, allowing the door 47 to remain in the open position is undesirable, as this allows the suction provided by the traveling suction cleaner to retain the batt 46 upon the filtration surface 30*a*. Rather, after each rotation, removal of the batt is desirable. Consequently, means are provided for returning the door 47 to its originally partially closed position, thereby isolating the batt 46 from the suction air flow and allowing the batt 46 to be purged free of the suction air flow.

Figure 7:
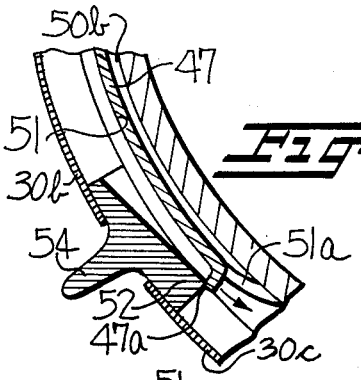
FIG. 7 is an enlarged partial cross-sectional view of a portion of FIG. 6 and showing certain aspects thereof in greater detail.
Figure 8:
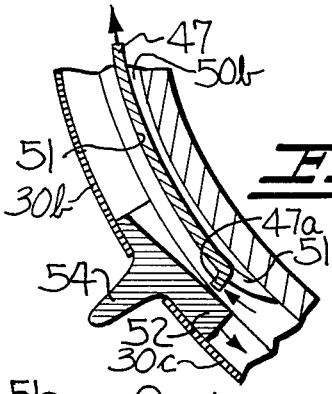
FIG. 8 is a similar enlarged partial cross-sectional view taken generally from FIG. 6 but showing movement of the filter means at a further point in time from FIG. 7.
Figure 9:
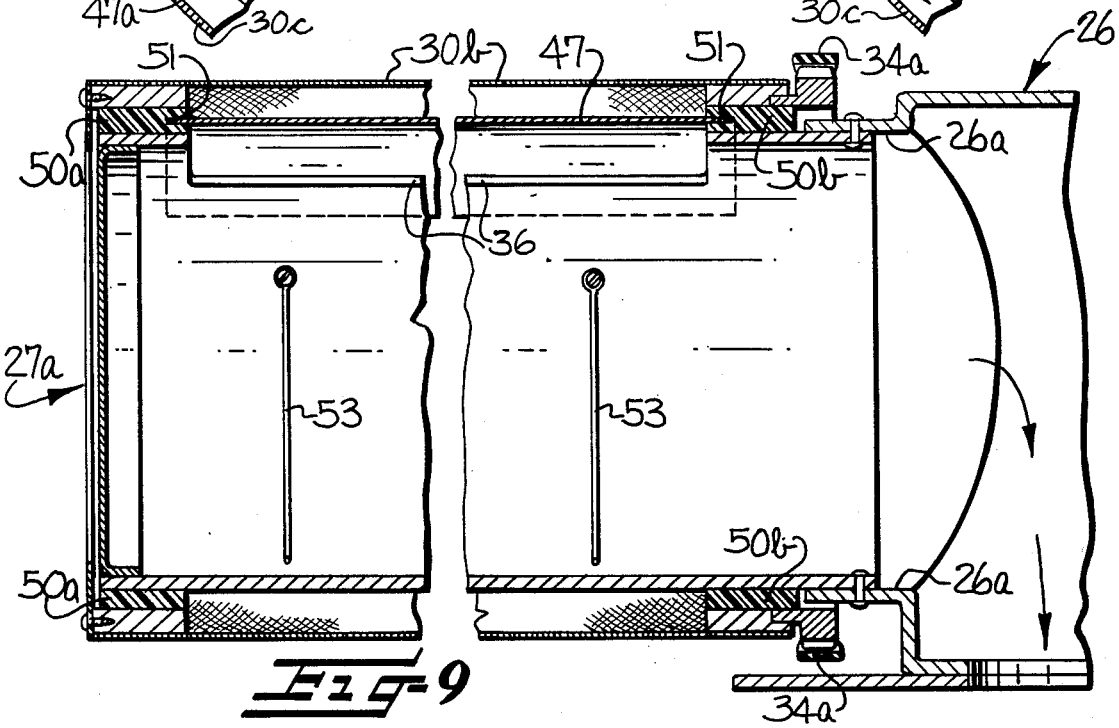
FIG. 9 is a longitudinal sectional view taken along lines 9—9 of FIG. 5.

As best illustrated in FIGS. 5–8, the means for returning the door 47 to its original partially closed position comprises a spring 53 and inwardly cammed portions 51*a* of the arcuate grooves 51 in the bearings 50. As best shown in FIGS. 7 and 8, as the foot 52 carries the lip 47*a* and the door 47 along the arcuate grooves 51, the leading edge of the door 47 will eventually travel inwardly along the inwardly cammed portions 51*a*. As the door 47 travels inwardly, the lip 47*a* becomes partially disengaged from the foot means 52 until, as shown in FIG. 8, the door 47 has moved far enough inwardly along the inwardly cammed portions 51*a* for the lip 47*a* to become totally disengaged from the foot 52. At this point, free of the abutment of the foot 52, the door 47 is mechanically free to be returned to its original closed position by the action of the spring 53 which has portions connected to the elongate tubular body 35 and other portions connected to the movable door 47.

Thus, as the filter means 27 rotates, the respective foot 52 carries the lip 47*a* and the door 47 along the arcuate grooves 51 in the bearings 50, opening the door 47. With the door 47 open, the suction air flow causes the batt 46 of textile waste material to be retained on filtration surface 30*a* while filtration surface 30*a* is being rotated. When the 90 degree rotation of filter means 27 is complete, the foot 52 will have carried the door 47 far enough along the arcuate grooves 51 to reach the inwardly cammed portions 51*a*. At this position the lip 47*a* will be moved inwardly far enough to disengage itself from the foot means 52 so that the spring 53 may return the door 47 to its original partially closed position. With door 47 returned to its originally partially closed position, the suction air flow is isolated from and will no longer retain the batt 46 of textile waste material on the filtration surface 30*a*. Thus, the batt 46 may be easily removed or transferred free of the suction air flow.

As a final step in the entire process, and in order to cause rotation of the filter means 27 to take place in a stepwise manner, there is provided a switch, broadly designated at 58, which is responsive to the rotation of the filter means 27. In the embodiment illustrated in FIGS. 5 and 6, the switch 58 comprises a roller portion 58*a* and a lever portion 58*b*. When the roller 58*a* is engaged by one of the flanges 54 on the filter means, a position shown in FIG. 5, the resulting position of the lever 58*b* causes the switch to stop the rotation of the filter means 27. Alternatively, when the roller 58*a* is free to rest against the surface of the filter means 27, a position shown in FIG. 6, the resulting position of the lever 58*b* allows rotation of the filter means 27 to continue until the switch 58 is engaged by the next flange 54. In this manner, the switch 58 causes rotation of the filter means 27 to stop at predetermined intervals, so that the filter means 27 will rotate in a stepwise manner, rather than continuously.

During the intervals between rotations of the filter means 27, in order to aid in the isolation of the suction air flow from both batt to be purged and environmental air in the textile mill, there are provided means, shown in the illustrated embodiment as the flanges 54 and the seals 59, for presenting suction air to the filter means 27 while isolating the portions from environmental air. As best shown in FIG. 5, the flanges 54 are positioned to partially engage particular edges 37*a* of the suction presentation chamber 37 while the seals 59 are located along the longitudinal edges of the air-ingress opening 36 and engage inner portions of the filter means 27. When the flanges 54 and seals 59 are so engaged, the suction air path defined by the component elements of the traveling suction cleaner is isolated from the environmental air in the textile mill. In the illustrated embodiment of the invention, the seals 59 engage inner portions of the foot means 52. It will be understood, however, that although such positioning of the foot means with respect to the seals is beneficially coincidential, it is not fundamental to the invention. Likewise, in the illustrated embodiment the flanges 54 are shown as being integral with the foot means 52. Such a coincidential position is also nonessential to the invention and it will be understood that even were flanges 54 and foot means 52 nonintegral, they could both be positioned so as to perform their appropriate functions.

As mentioned previously herein, the time or distance intervals in a textile mill at which the filter means can be rotated and purged are not an inherent characteristic or necessary element of the invention. Rather, the invention provides greater flexibility than previous traveling cleaners by allowing the interval of rotation to be determined by the various individual cleaning requirements of any particular situation. Accordingly, the means for successive aligning of the filter sections also comprises a signal receiving means shown in the form of a trigger 55, best illustrated in FIG. 3 and also visible in FIG. 1. The trigger 55 is responsive to signal means external the traveling suction blower cleaner, an example of which signal means is illustrated as a trip rod 56 in FIGS. 1 and 3 positioned on the track 57 upon which the traveling suction blower cleaner moves. The motor 31 is responsive to the trigger 55 such that when the trigger 55 engages a trip rod 56, or other appropriate signaling device, the motor will be operated and will cause one stepwise rotation of each of the respective filter means 27*a* and 27*b*, and will also cause the associated movements of other portions of the traveling suction cleaner which have been set out earlier herein.

As is true in the case of all traveling cleaners, the frequency with which the filter means of the present invention will need to be cleaned will generally depend on environmental factors. Such factors include the number of textile machines to be cleaned during one circuit of travel of the cleaner, the total number of frames to be cleaned in a textile mill, the number of waste removal stations available along one circuit and in the mill as a whole, the type of machinery cleaned, the type of fiber being processed and the frequency with which the traveling cleaner must pass any given particular location in order to keep machinery at that location clean. With regard to the present invention, since the filter means will be rotated whenever the trigger 55 engages a trip rod 56, the intervals between successive rotations of the filter means 27 will depend solely on the placement of appropriate signaling means. The present invention thus provides great flexibility in that the trip rods 56 may be placed in locations tailored to cause rotation of the filter means 27 at intervals responsive to the aforementioned environmental factors. Additionally, the traveling suction cleaner need not be tailored for particular textile mills or locations, but rather the mere placement of signaling means and waste removal means at appropriate locations will automatically customize the stepwise rotation, purging and presentation for waste removal of the filter means 27.

Because the present invention causes textile waste material to be presented for removal exteriorly to the traveling suction cleaner, the exteriorly presented textile waste material may be consequently transferred from the traveling suction cleaner while the traveling suction cleaner is in motion. Previously, because traveling cleaners usually collected textile waste material at interior portions of such cleaners, purging of the filter surface and removal of waste usually required that the cleaner be stopped and then cleaned manually or at an automatic cleaning station. The design of the present invention which provides for such a simple manner of waste removal is one of its most advantageous features.

In further relation to environmental factors, the present invention may be advantageously operated on either continuous track circuits or on reversing track circuits. When operated on reversing track circuits, the means for exterior presentation of waste for removal provide a way for waste removal to take place while the traveling cleaner is moving in either direction.

Additionally, it is not necessary that the particular locations of the suction duct means 22, the suction presentation chamber 37, and the filter means 27 all be in their illustrated positions with respect to the housing 26. Nor is it necessary that rotation of the filter means 27 cause collected waste material to be rotated upwardly with respect to the floor of a textile mill, but rather it will be understood that such rotation could be used to rotate collected textile waste material in any desired direction to any desired waste removal position. For example, the filter means could be rotated downwardly in order to provide waste removal from below the traveling suction cleaner, be it by suction means, mechanical means, or even by gravity.

Figure 12:
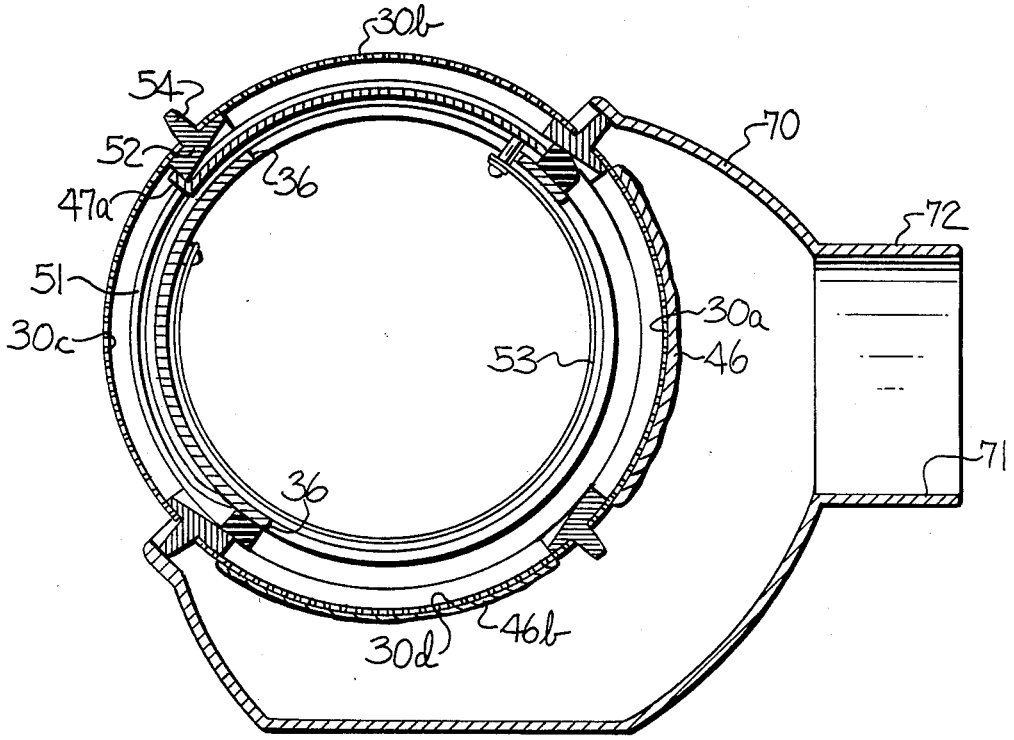
FIG. 12 is a cross-sectional view of a second embodiment of the invention, and showing a second form of section presentation chamber.

An example of one such alternative embodiment of one feature of the invention is illustrated in FIG. 12. In this embodiment, the suction presentation chamber is designated at 70 and includes an annular member 72 extending transversely therefrom and having an opening 71 therein, such that the annular member 72 and the opening therein 71 correspond to the annular member 42 and the opening therein 41 illustrated in FIGS. 4, 5 and 6. In the embodiment shown in FIG. 12, the suction presentation chamber is shaped and positioned to extend substantially over two of the illustrated segments of filtration surface 30*a* and 30*d*, respectively. As in the earlier embodiment, suction air carrying entrained textile waste will be carried into the suction presentation chamber 70 and in the embodiment shown in FIG. 12, will be retained against filtration surface 30*d* as well as filtration surface 30*a* as in previous embodiments. As in the case of the previous embodiment, upon an appropriate signal the entire filter means 27 will still be rotated such that segment 30*a* will be rotated to the position initially occupied by surface 30*b*, section 30*d* will be rotated to the position previously occupied by section 30*a*, and section 30*c* will be correspondingly rotated to occupy the position previously occupied by section 30*d*. Thus, section 30*d* is not rotated out of the suction air path after one rotation, but will be rotated out of the suction air path upon a second rotation. It will be seen that because the filtration surface occupying the position illustrated by 30*a* will always have spent twice as long in the suction air path as the filtration surface illustrated by 30*d* has spent there, rotation of only section 30*a* out of the suction air path will nevertheless purge the greatest amount of textile waste from the filtration surfaces which are exposed to the suction air path at any given time. Similarly, by the time the next rotation takes place, section 30*d* will have spent twice as long within the suction air path as section 30*c* will have and consequently will carry the majority of waste with it when one stepwise rotation of the filter means 27 takes place. Again, it will be seen that the particular embodiment of the suction presentation chamber 70 illustrated in FIG. 12 is only one of several embodiments which may be produced without departing from the spirit or novelty of the present invention.

Finally, as is common to traveling suction cleaners, there is provided means for causing the traveling suction cleaner 20 to be carried over or adjacent one or more textile machines. In the illustrated embodiment of the invention, this means comprises the illustrated track 57, a propulsion motor 60 and drive wheels 61, as well as guide rollers 62 for engaging the track 57. When the propulsion motor 60 turns the drive wheels 61, the traveling suction cleaner will be propelled along the track 57 and will be traveled along textile machinery such as the spinning frame 21 illustrated in FIG. 1.

The foregoing embodiments are to be considered illustrative, rather than restrictive of the invention, and those modifications which come within the meaning and range of equivalence of the claims are to be included therein.

I claim:

1. A traveling suction floor cleaner for cleaning textile mills and adapted for periodic removal of textile waste material collected by the cleaner, said traveling suction cleaner comprising:

a suction blower fan;

means for causing said suction blower fan to travel adjacent one or more textile machines;

a housing for enclosing said suction blower fan;

suction duct means communicating with said housing and arranged for carrying suction air and entrained textile waste material from the floor of a textile mill to said suction blower fan;

said suction blower fan, said housing and said suction duct means defining a suction air path;

filter means having filtration surfaces positioned within said suction air path for receiving entrained textile waste material while permitting air flow therethrough; and means for moving said filter means for successive presentation for filtration of clean filtration surfaces on said filter means to collect textile waste from the suction air path, and for concurrent successive presentation for waste removal of filtration surfaces on said filter means having collected textile waste material thereon.

2. A traveling cleaner for cleaning textile mills and adapted for periodic removal of textile waste material collected by the cleaner, said traveling suction cleaner comprising:

a suction blower fan;

means for causing said suction blower fan to travel adjacent one or more textile machines;

a housing for enclosing said suction blower fan;

suction duct means communicating with said housing and arranged for carrying suction air and entrained textile waste material from the floor of a textile mill to said suction blower fan;

blower duct means communicating with said housing and arranged for blowing air onto textile machinery for removing textile waste from said machinery;

said suction blower fan, said housing, said suction duct means and said blower duct means together defining an air flow path;

filter means having filtration surfaces positioned within said air flow path for receiving entrained textile waste material while permitting air flow therethrough; and means for moving said filter means for successive presentation for filtration of clean filtration surfaces on said filter means to collect textile waste from said air flow path, and for concurrent successive presentation for waste removal of filtration surfaces on said filter means having collected textile waste material thereon.

3. A traveling cleaner for cleaning textile mills and adapted for periodic removal of textile waste material collected by the cleaner, said traveling suction cleaner comprising;

a suction blower fan;

means for causing said suction blower fan to travel adjacent one or more textile machines;

a housing for enclosing said suction blower fan;

suction duct means communicating with said housing and arranged for carrying suction air and entrained textile waste material from the floor of a textile mill to said suction blower fan;

said suction blower fan, said housing and said suction duct means defining a suction air path;

blower duct means communicating with said housing and arranged for blowing air onto textile machinery for removing textile waste from said machinery;

said suction blower fan, said housing and said blower duct means defining a blowing air path;

filter means having filtration surfaces positioned within said suction air path and communicating with said suction duct means and said suction blower fan; and means for moving said filter means for successive presentation for filtration of clean filtration surfaces on said filter means, and for concurrent successive presentation for waste removal of filtration surfaces on said filter means having collected textile waste material thereon, whereby air blown onto textile machinery has been filtered of entrained waste removed from the floor.

4. A traveling cleaner according to claim 3 wherein said suction air path and said blowing air path communicate with one another and define a single air path.

5. A traveling suction floor cleaner for cleaning textile mills and adapted for periodic removal of textile waste material collected by the cleaner, characterized by means for successive presentation for filtration of clean filtration surfaces to a suction air flow carrying entrained waste and means for concurrent successive presentation for waste removal of other filtration surfaces carrying collected textile waste material thereon, said traveling suction cleaner comprising:

a suction blower fan;

means for causing said suction blower fan to travel in a path adjacent one or more textile machines;

a housing for enclosing said suction blower fan;

at least one elongate tubular body extending from said housing and communicating with said suction blower fan and having a longitudinally extending air-ingress opening therein;

suction duct means carried by said housing and communicating with said air-ingress opening in said tubular body and arranged for carrying suction air and entrained textile waste material from the floor of a textile mill to said opening;

rotatable tubular filter means in surrounding relation to said elongate tubular body and comprising a series of foraminous sections for being successively presented to said air-ingress opening; and means for successively aligning respective filter sections with said air-ingress opening in said tubular body, and for moving a first section out of registration with said opening in said tubular body while moving a succeeding section into registration with said opening in said tubular body such that said first section may be presented for waste removal and said succeeding section may present a clean filtration surface to the suction air flow at said air-ingress opening.

6. A traveling suction floor cleaner according to claim 5 further comprising:

movable closure means positioned adjacent said elongate tubular body for partially closing said longitudinally extending opening therein, said movable closure means being in a normally partially closed position; and means associated with said movable closure means operable in timed relation with the successive movement of said tubular filter means for opening said movable closure means for a predetermined interval and then returning said movable closure means to a normally partially closed position, whereby when said closure means is opened suction provided by said suction blower fan causes textile fiber waste to be retained on said respective section of said continuous filter, and when said closure means is closed, permits removal of the collected textile waste from said respective section of said continuous filter free of the suction air flow through said elongate tubular body.

7. A traveling suction floor cleaner according to claim 6 wherein said moveable closure means comprises an arcuate section.

8. A traveling suction cleaner according to claim 6 wherein said means operable in timed relation with said filter means for opening and closing said moveable closure means further comprises;

bearing means on respective opposite ends of said tubular body for carrying thereon said filter means so that said filter means rotates on said bearing means;

means on said bearing means for carrying said moveable closure means so that said moveable closure means may be opened and closed;

foot means on said filter means for engaging said movable closure means during rotation of said filter means such that engagement of said foot means with said movable closure means opens said closure means from its normally partially closed position;

lip means on said moveable closure means for being abuttingly engaged by said foot means such that rotation of said filter means causes said foot means to be abuttingly engaged by said lip means and thereby open said closure means during rotation of said filter means;

means on said bearing means for disengaging said moveable closure means from said foot means; and spring means, portions of which are positioned on said closure means and portions of which are positioned on said tubular body, for returning said closure means to a normally partially closed position when said disengagement means disengages said closure means from said foot means.

9. A traveling suction floor cleaner according to claim 5 wherein said elongate tubular body comprises a cylinder.

10. A traveling suction floor cleaner according to claim 5 having a pair of said elongate tubular bodies.

11. A traveling cleaner according to claim 5 wherein said filter means comprises a cylinder having a series of arcuate conjoint foraminous segments.

12. A traveling suction floor cleaner according to claim 11 having four of said arcuate conjoint foraminous segments.

13. A traveling suction floor cleaner for cleaning textile mills and adapted for periodic removal of textile waste material collected by the cleaner, characterized by means for successive presentation for filtration of clean filtration surfaces to a suction air flow carrying entrained waste and means for concurrent successive presentation for waste removal of other filtration surfaces carrying collected waste material thereon, said traveling suction cleaner comprising:

a suction blower fan;

means for causing said suction blower fan to travel in a path adjacent one or more textile machines;

a housing for enclosing said suction blower fan;

at least one elongate tubular body extending from said housing and communicating with said suction blower fan and having a longitudinally extending air ingress opening therein;

suction duct means carried by said housing and communicating with said air ingress opening in said tubular body and arranged for carrying suction air and entrained textile waste material from the floor of a textile mill to said opening;

rotatable tubular filter means in surrounding relation to said elongate tubular body and comprising a series of foraminous sections for being successively presented to said air ingress opening; and means for successively aligning at least one respective filter section with said air ingress opening in said tubular body, and for moving at least one first section out of registration with said opening in said tubular body while moving at least one succeeding section into registration with said opening in said tubular body such that said first section may be presented for waste removal and said succeeding section may present a clean filtration surface to the suction air flow at said air ingress opening.

14. A traveling suction floor cleaner according to claim 13 further comprising means for successively aligning first and second respective filter sections with said air ingress opening in said tubular body and for moving said first section out of registration with said opening in said tubular body while moving a third section into registration with said opening in said tubular body such that said first section may be presented for waste removal, said second section remains in registration with said opening and said third section presents a clean filtration surface to the suction air flow at said air ingress opening.

15. A traveling suction floor cleaner for cleaning textile mills and adapted for periodic removal of textile waste material collected by the cleaner, characterized by means for successive presentation for filtration of clean filtration surfaces to a suction air flow and means for concurrent successive presentation for waste removal of other filtration surfaces carrying collected textile waste material, said traveling suction cleaner comprising:

a suction blower fan;

means for causing said suction blower fan to travel adjacent textile machines;

a housing for enclosing said suction blower fan;

at least one cylindrical tubular body extending from said housing and communicating with said suction blower fan and having a longitudinally extending air-ingress opening therein;

suction duct means carried by said housing and communicating with said air-ingress opening in said cylindrical body and arranged for carrying suction air and entrained textile waste material from the floor of a textile mill to said opening;

rotatable cylindrical tubular filter means in surrounding relation to said cylindrical tubular body and comprising a series of arcuate conjoint foraminous sections for being successively presented to said air-ingress opening;

means for stepwise succcessive aligning of respective conjoint filter sections with said air-ingress opening in said tubular body, and for moving a first section out of registration with said opening in said tubular body while moving a succeeding section into registration with said opening in said tubular body such that said first section may be presented for waste removal and said succeeding section may present a clean filtration surface to the suction air flow at said air-ingress opening;

a movable arcuate door positioned adjacent said elongate tubular body for partially closing said longitudinally extending opening therein, said arcuate door being in a normally partially closed position; and means associated with said door operable in timed relation with the stepwise successive movement of said tubular filter means for opening said door for a predetermined interval and then returning said door to a normally partially closed position, whereby when said door is opened suction provided by said suction blower fan causes textile fiber waste to be retained on said respective conjoint section of said continuous filter, and when said door is closed, permits removal of the collected textile waste from said respective conjoint section of said continuous filter free of the suction air flow through said elongate tubular body.

16. A traveling suction cleaner according to claim 15 wherein said means associated with said door operable in timed relation with the movement of said filter means for opening and closing said door further comprises;

a pair of annular bearings positioned on opposite ends of said cylindrical tubular body for carrying thereon said filter means so that said filter means rotates on the peripheral surfaces of said bearings;

arcuate grooves positioned on the inside surfaces of said annular bearings with the respective grooves facing one another, for carrying therein opposite side edges of said arcuate door so that said arcuate door may move in said grooves during said opening and closing of said door;

a plurality of projecting feet positioned on the inner periphery of said cylindrical filter means and depending therefrom towards said cylindrical tubular body for engaging said arcuate door during rotation of said filter such that the engagement of the projecting feet and the door serve to open the door from its normally partially closed position;

a lip extending upwardly from and lengthwise along one lengthwise edge of said door towards said cylindrical filter means for being abuttingly engaged by said projecting feet on said filter means such that rotation of said filter means causes at least one of said projecting feet to abuttingly engage said lip and carry said door along said grooves and thereby open said door;

inwardly cammed portions of said arcuate grooves positioned adjacent one end of said arcuate grooves for allowing said door to travel further inwardly in said grooves so that as said door travels inwardly said lip correspondingly moves inwardly away from said projecting feet and eventually disengages from said feet; and spring means, portions of which are positioned on said door and portions of which are positioned on said cylindrical body, for returning said door to its normally partially closed position when said lip disengages said projecting elements.

17. A traveling suction cleaner according to claim 5 wherein said means for successive aligning of said filter sections further comprises:

signal receiving means positioned on said housing and responsive to signal means external the traveling suction cleaner for signaling said filter means to be rotated;

a motor positioned on said housing and responsive to said signal receiving means for rotating said filter means;

transmission means associated with said motor and with said filter means for rotating said filter means in response to said motor and in response to said signal receiving means such that a predetermined external signal causes said motor to operate, causes said filter means to be rotated and causes said filter sections to be successively presented to said air ingress opening and to be successively presented for waste removal.

18. A traveling suction cleaner according to claim 5 wherein said means for successive alignment of said filter sections further comprises:

a switch positioned on said housing and responsive to signal means external the traveling suction cleaner for causing said respective filter sections to be successively aligned;

a motor positioned on said housing and responsive to said switch for rotating said filter means when said external signal means triggers said switch;

a transmission positioned adjacent and coupled to said motor for allowing said motor to drive said rotatable filter means by transmitting the driving force of said motor to said filter means;

a drive shaft associated with and obedient to said transmission;

shaft gears mounted on said drive shaft for movement in unison therewith;

filter gears mounted on said filter means and enmeshed with said shaft gears for rotating said filter means in response to rotation of said shaft and said shaft gears such that said filter means rotates in response to said motor.

19. A traveling suction cleaner according to claim 18 further comprising a second switch positioned adjacent said filter means and responsive to said rotation of said filter means for stopping said rotation at a predetermined interval, such that said filter means will rotate in a stepwise manner, rather than continuously.

20. A traveling suction floor cleaner according to claim 5 including waste carrying means associated with said filter means for carrying collected textile waste on portions of said filter means exterior to the suction air path and exterior to said housing such that externally carried collected textile waste may be more readily removed from said filter means.

21. A traveling suction floor cleaner according to claim 5 including means associated with said filter means and with said elongate tubular body for providing a continuous suction air flow during said successive alignment of respective filter sections such that filtration of suction air carrying entrained textile waste continues uninterrupted during said successive alignment of said filter sections.

22. A traveling suction floor cleaner according to claim 5 including means on said filter sections of said filter means for retaining thereon a substantially cohesive mass of collected textile waste material such that the retained textile waste material provides additional filtration capability to said filter means and may be more readily purged from said suction air path and may be more readily removed from the traveling suction floor cleaner.

23. A traveling suction floor cleaner according to claim 5 including waste removal presentation means adjacent said elongate tubular bodies for presenting textile waste collected by said filter means for removal of said collected textile waste either while said cleaner is traveling or while said cleaner is stationary.

24. A traveling suction cleaner according to claim 5 including means positioned on said housing in communication with said suction duct means and in communication with said air ingress opening for presenting suction air to said filter means while isolating portions of said filter means from environmental air such that said suction blower fan draws air exclusively from said suction duct means independent of other environmental air.

25. A traveling suction cleaner according to claim 24 wherein said means for presenting suction air to said filter means comprises:

a suction presentation chamber positioned longitudinally adjacent said elongate tubular body and substantially overlying said air ingress opening and communicating with said air ingress opening and with said suction duct means;

edges of said suction presentation chamber being positioned adjacent said filter means in closely spaced relation thereto; and a plurality of air-isolating flanges positioned longitudinally on said filter means and extending radially outwardly therefrom for engaging said edges of said suction presentation chamber such that when said flanges engage said edges air with entrained textile waste will be carried from said suction duct means to said filter means independent of other environmental air.

26. A traveling cleaner according to claim 5 and further comprising:

at least two blower duct means communicating with said housing and being positioned on respective opposite sides of said housing and towards respective opposite ends of said housing and arranged for blowing air onto textile machinery for removing textile waste from said machinery;

a pair of said elongate tubular bodies positioned such that the longitudinal dimensions thereof are generally parallel to the path of travel of said suction blower fan and generally overlie the path of travel of said suction blower fan;

at least two of said suction duct means, said suction duct means being positioned on respective opposite sides of said housing and generally alongside of said elongate tubular bodies such that there is positioned one of said suction duct means and one of said blower duct means on each respective side of said housing and such that one of said suction duct means on each respective side of said housing is opposite one of said blower duct means on the other respective side of said housing;

the respective positions of said blower duct means, said suction duct means and said elongate tubular bodies cooperating to provide increased balance and stability to the traveling cleaner and to reduce its lateral overhang and to thus more efficiently use the space available for the travel of the traveling cleaner.

27. A method of cleaning textile machinery and floors and of periodic purging and removal of textile waste material collected during said cleaning, said method comprising:

causing a traveling suction cleaner, component parts of which define a path of suction air flow, to travel adjacent textile machines to be cleaned and to create a suction air flow;

using said suction air flow to carry air and entrained textile waste material from the floor of a textile mill to filter means positioned on said traveling suction cleaner; and successively aligning respective sections of said filter means with said path of suction air flow while moving preceding sections out of said path of suction air flow such that said preceding sections are presented for waste removal and said successive sections present clean filtration surfaces to said suction air flow.

28. A method of cleaning textile machinery and floors and of periodic purging and removal of textile waste material collected during said cleaning, said method comprising:

causing a traveling suction cleaner, component parts of which define a path of suction air flow, to travel adjacent textile machines to be cleaned and to create a suction air flow;

using said suction air flow to carry air and entrained textile waste material from the floor of a textile mill to filter means positioned on said traveling suction cleaner;

successively aligning respective sections of said filter means with said path of suction air flow while moving preceding sections out of said path of suction air flow such that said preceding sections are presented for waste removal and said successive sections present clean filtration surfaces to said suction air flow; and removing the collected textile waste material from the respective filter sections as they are presented for waste removal.

29. A method according to claim 28 wherein said waste removal comprises suction waste removal from the respective filter sections.

30. A method of cleaning textile machinery and floors and of periodic purging and removal of textile waste material collected during said cleaning, said method comprising:

causing a traveling suction cleaner, component parts of which define a path of suction air flow, to travel adjacent textile machines to be cleaned and to create a suction air flow;

using said suction air flow to carry air and entrained textile waste material from the floor of a textile mill to filter means positioned on said traveling suction cleaner;

successively aligning respective sections of said filter means with said path of suction air flow while moving preceding sections out of said path of suction air flow such that said preceding sections are presented for waste removal and said successive sections present clean filtration surfaces to said suction air flow; and using said suction air flow to cause textile fiber waste to be retained on a first section of said filter means while said first section is being moved out of said suction air path and then isolating said first section from said suction air path such that removal of the collected textile waste from said first section of said filter may take place free of said suction air flow.

31. A method of cleaning textile machinery and floors and of periodic purging and removal of textile waste material collected during said cleaning, said method comprising:

causing a traveling suction cleaner, component parts of which define respective paths of suction air flow and blowing air flow, to travel adjacent textile machines to be cleaned and to create a suction air flow and a blowing air flow;

using said blowing air flow to blow textile waste material off of textile machinery and onto the floor of a textile mill;

using said suction air flow to carry air and entrained textile waste material from the floor of a textile mill to filter means positioned on said traveling suction cleaner; and successively aligning respective sections of said filter means with said path of suction air flow while moving preceding sections out of said path of suction air flow such that said preceding sections are presented for waste removal and said successive sections present clean filtration surfaces to said suction air flow.

32. A method of cleaning textile machinery and floors and of periodic purging and removal of textile waste material collected during said cleaning, said method comprising;

causing a traveling suction cleaner, component parts of which define respective paths of suction air flow and blowing air flow, to travel adjacent textile machines to be cleaned and to create a suction air flow and a blowing air flow;

using said blowing air flow to blow textile waste material off of textile machinery and onto the floor of a textile mill;

using said suction air flow to carry air and entrained textile waste material from the floor of a textile mill to filter means positioned on said traveling suction cleaner;

successively aligning respective sections of said filter means with said path of suction air flow while moving preceding sections out of said path of suction air flow such that said preceding sections are presented for waste removal and said successive sections present clean filtration surfaces to said suction air flow; and using said suction air flow to cause textile fiber waste to be retained on a first section of said filter means while said first section is being moved out of said suction air path and then isolating said first section from said suction air path such that removal of the collected textile waste from said first section of said filter may take place free of said suction air flow.

33. A method of cleaning textile machinery and floors and of periodic purging and removal of textile waste material collected during said cleaning, said method comprising:

causing a traveling suction cleaner, component parts of which define respective paths of suction air flow and blowing air flow, to travel adjacent textile machines to be cleaned and to create a suction air flow and a blowing air flow;

using said blowing air flow to blow textile waste material off of textile machinery and onto the floor of a textile mill;

using said suction air flow to carry air and entrained textile waste material from the floor of a textile mill to rotatable tubular filter means positioned on said traveling suction cleaner; and successively aligning respective sections of said rotatable tubular filter means with said path of suction air flow by moving a first section out of registration with said path of suction air flow while moving a succeeding section into registration with said path of suction air flow such that said first section is presented for waste removal and said successive section presents a clean filtration surface to said suction air flow.

34. A method of cleaning textile machinery and floors and of periodic purging and removal of textile waste material collected during said cleaning, said method comprising:

causing a traveling suction cleaner, component part of which define respective paths of suction air flow and blowing air flow, to travel adjacent textile machines to be cleaned and to create a suction air flow and a blowing air flow;

using said blowing air flow to blow textile waste material off of textile machinery and onto the floor of a textile mill;

using said suction air flow to carry air and entrained textile waste material from the floor of a textile mill to rotatable tubular filter means positioned on said traveling suction cleaner;

successively aligning respective sections of said rotatable tubular filter means with said path of suction air flow by moving of a first section out of registration with said path of suction air flow while moving a succeeding section into registration with said path of suction air flow such that said first section is presented for waste removal and said successive section presents a clean filtration surface to said suction air flow; and using said suction air flow to cause textile fiber waste to be retained on said first section while said first section is being moved out of registration with said suction air path and then isolating said first section from said suction air path such that removal of the collected textile waste from said first section of said filter may take place free of said suction air flow.

35. A method of cleaning textile machinery and floors and of periodic purging and removal of textile waste material collected during said cleaning, said method comprising:

causing a traveling suction cleaner, component parts of which define a path of suction air flow, to travel adjacent textile machines to be cleaned and to create a suction air flow;

using said suction air flow to carry air and entrained textile waste material from the floor of a textile mill to filter means positioned on said traveling suction cleaner; and successively aligning at least one section of said filter means with said path of suction air flow while moving at least one preceding section out of said path of suction air flow such that said preceding at least one section is presented for waste removal and said successive at least one section presents cleaned filtration surfaces to said suction air flow.

36. A method of cleaning textile machinery according to claim 35 further comprising aligning first and second sections of said filter means with said path of suction air flow while moving a preceding third section out of said path of suction air flow such that said preceding third section is presented for waste removal and said first and second sections present filtration surfaces to said suction air flow.

* * * * *